United States Patent [19]

Jewell, Jr.

[11] Patent Number: 4,967,633

[45] Date of Patent: Nov. 6, 1990

[54] ADJUSTABLE WIND CHIME CLAPPER SUPPORT

[76] Inventor: James D. Jewell, Jr., 1178 W. Kitty Hawk Rd., Kitty Hawk, N.C. 27949

[21] Appl. No.: 473,738

[22] Filed: Feb. 2, 1990

[51] Int. Cl.[5] ..... G10D 13/08

[52] U.S. Cl. ..... 84/404; D17/22; D17/99; D11/141; D10/116; D10/119

[58] Field of Search ..... 84/404, 402; 116/141, 116/169; 446/421; D17/22, 99; D11/141; D10/116, 119

[56] References Cited

U.S. PATENT DOCUMENTS

| | | | |
|---|---|---|---|
| D. 250,455 | 12/1978 | Mohrhauser | D11/141 X |
| D. 279,873 | 7/1985 | Neely | D10/116 |
| 864,461 | 8/1907 | Gibbs | 84/402 X |

*Primary Examiner*—Brian W. Brown

*Attorney, Agent, or Firm*—Olive & Olive

[57] ABSTRACT

A wind chime of the type in which a clapper strikes individual ones of a group of resonant vertical tubes incorporates an adjustable support for enabling the position of the clapper to be easily changed on the strand on which the clapper is hung to thereby change the tone or to effectively silence the chime.

3 Claims, 1 Drawing Sheet

ADJUSTABLE WIND CHIME CLAPPER SUPPORT

BACKGROUND OF INVENTION

Field of the Invention

The invention relates to a wind chime of the type in which a clapper piece, hung in pendular fashion, is swung by the wind into resonant tubes, thereby causing chiming sounds. In particular, the invention is directed to a type of clapper support piece which allows the vertical pendulum action length of the clapper to be adjustable.

Background of the Invention

Wind chimes typically are made with the vertical pendulum action length of the clapper fixed in one non-adjustable position. This arrangement has the disadvantage of not being able to silence the chimes or to change the tone by changing the clapper position.

The object of the present invention is to overcome these disadvantages by providing a clapper support which enables the clapper position to be adjusted to change the tone and when desired to position the clapper so that it will not strike the tubes.

SUMMARY OF THE INVENTION

The invention comprises a wind chime clapper support built out of a hollow tube the upper end of which is snugly nested in a hole formed through the center of the wind chime clapper, with the line supporting the clapper being threaded through this hollow tube. The geometry of this support tube, combined with the material qualities of the tube and line, are such that the friction between the support line and the inside of the hollow tube is sufficient to hold the clapper at a given vertical pendulum action length without slipping due to normal stress, motion, or gravity, while allowing the clapper to be easily manually repositioned anywhere along the support line. Thus, the pendulum action length of the clapper can be changed simply by holding the support line and pushing or pulling the clapper up or down along the line. Despite the shaping used to achieve this characteristic, the geometry of the clapper support device is balanced and maintains the entry point for the support line above the clapper and the exit point for the support line below the clapper in close vertical alignment, so the clapper, the clapper support tube, and any weight hung beneath such as a wind baffle are substantially in vertical alignment when at rest.

DESCRIPTION OF THE PREFERRED EMBODIMENT

Figure 1:
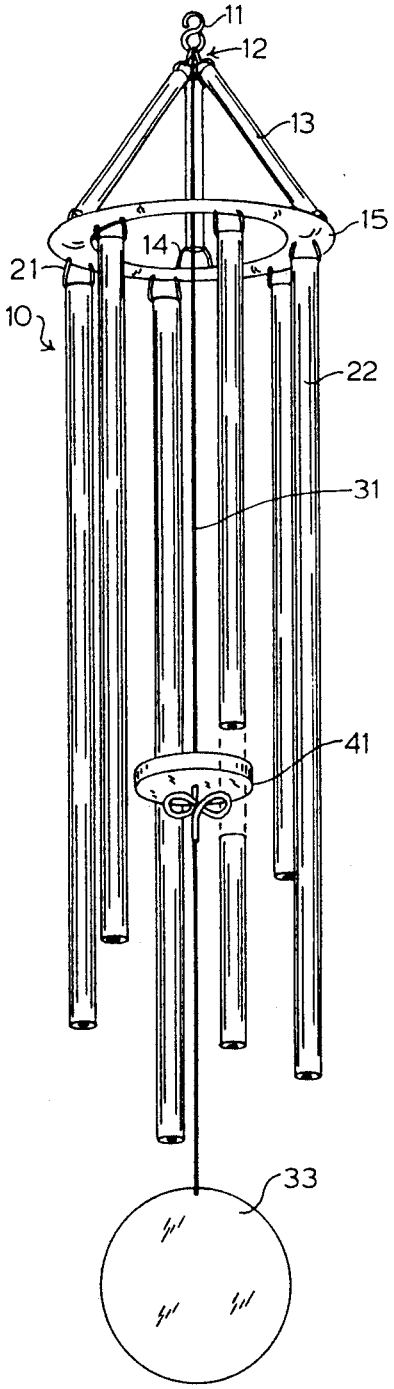
FIG. 1 is a perspective view of a wind chime device, according to the invention.

The wind chime assembly 10 is attached to a centrally positioned main supporting metal hook 11 by which the wind chime is hung vertically in place.

The lower end of the main support hook 11 is attached to the upper end of each of three hollow metal tubes 13 of identical length and diameter. The lower end of each of these three tubes 13 is attached to an annular frame formed of a metal tube 15. The point of attachment of each tube 13 to the frame 15 as viewed from above is at approximately 120 degrees from that of each of the other two, with the three tubes 13 being arranged around a circumference of constant radius on the surface of the tubular frame 15, so that they are balanced relative to one another.

Aside from contributing to the attractiveness of the wind chime assembly 10, each of the three metal tubes 13 also acts as a guide for one of three partially illustrated respective frame support lines 14. Each of these frame support lines is attached at the top 12 to the main support hook 11 and at the bottom end to the tubular frame 15. Due in part to scale, only very small portions of the frame support line 14 are discernable in FIG. 1. The frame support lines 14 are preferably made of clear nylon fishing line of suitable strength.

The annular shaped and tubular frame 15 serves to support six hollow resonant metal tubes 22 which are the "chimes" and which hang vertically from the supporting frame 15, distributed symmetrically along the circumference of the frame 15 such that each resonant tube 22 as viewed from above is approximately 60 degrees apart from the adjacent tubes. The resonant tubes 22 are independently hung from the bottom of frame 15 by separate support lines 21. The resonant tube support line 21 for each resonant tube should be of sufficient length that the resonant tube 22 hangs completely free of the frame 15. A larger or smaller number of tubes may of course be employed and conventional fishing line and line connectors are suited to being used.

The clapper 41 consists of a round solid circular disc of a diameter which is preferably appreciably smaller than the circumference of the circle described as tangent to the inside of the six resonant tubes 22 when standing vertically still, but of suffucient mass and diameter such that, when the clapper 41 is swung by gentle human touch or by a small breeze, it easily collides with the resonant tubes to cause a ringing or chiming sound. The actual clapper 41 material may be of any suitable material e.g. plastic, metal, ceramic, or wood, that meets these criteria.

The clapper 41 is hung from the wind chime support hook 11 on a single vertical support line or strand 31 of suitable form and strength such as a clear nylon fishing line. In this regard, it is important that the clapper support line material have some modest, but not extreme frictional characteristic against sliding when nested against a smooth but not slick metallic surface, such as the inside of a hollow copper pipe such as employed for the later described clapper support tube 42. The upper end of the clapper support line 31 is attached to the main support hook 11 by appropriate fastening means such as employed with fishing lines.

The clapper 41 is formed with a central hole in which the upper end of a small hollow metal clapper support tube 42 is snugly fitted although glue or other adhesive on the outside of the clapper support tube 42 may be used, if necessary, as an augmenting measure.

Figure 2:
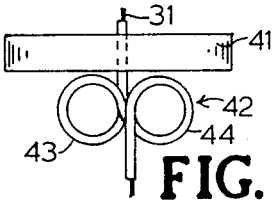
FIG. 2 is an elevation view of a double-loop embodiment of the clapper support, with this particular first embodiment employing a pair of loops or turns located side by side in the tube forming the clapper support.
Figure 3:
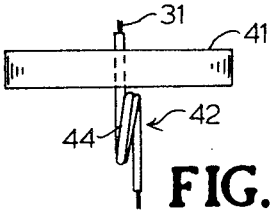
FIG. 3 is an end view of the clapper support shown in FIG. 2.
Figure 4:
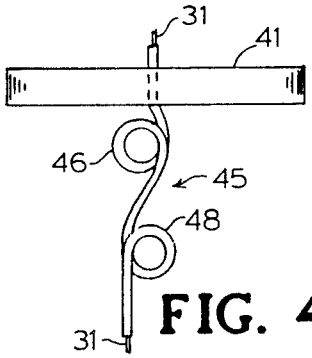
FIG. 4 is an elevation view of a second double-loop embodiment of the clapper support in which a pair of loops or turns are located one above the other in the tube forming the clapper support.
Figure 5:
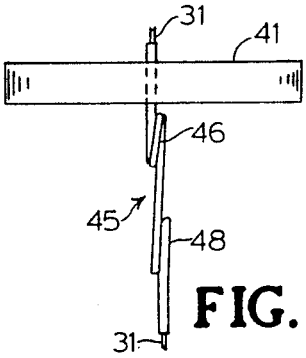
FIG. 5 is an end view of the clapper support shown in FIG. 4.

In the first embodiment of FIGS. 2 and 3, the clapper support line 31 is threaded into the top of the metal support tube 42, threaded entirely through two circular, side by side loops or turns 43, 44 and then continues out the bottom of the support tube 42, with the line 31 continuing downward until it terminates where tied to a circular disc 33 which serves both as a wind baffle and as a small weight to keep the clapper support line 31 hanging straight. In a second embodiment, shown in FIGS. 4 and 5, the support tube 45 is formed with two vertical loops or turns 46, 48 through which the line 31 is threaded.

The clapper support line 31 outer diameter and the clapper support tube 42 inner diameter should be reasonably close, but not identical. The important characteristic for purpose of the invention is that the diameters be sufficiently close that contact, and thereby friction, will be continuously maintained between the clapper support line 31 and the inside of the clapper support tube 42 yet not be so snug that the clapper support line 31 cannot be slid through the clapper support tube 42 if the clapper 41 is forced with sufficient manual pressure to move on clapper support line 31. Thus, the clapper 41 can be repositioned to change the tone or to move completely out of contact with the tubes 22 to effectively silence the chimes. Additionally, the clapper support tube of the invention when mounted and used as illustrated and described serves the important function of levelling the clapper 41.

I claim:

1. A wind chime assembly, comprising:

(a) a frame assembly made up of an annular frame and hanger means adapted to support the frame in a horizontal position in a manner enabling the wind chime assembly to swing therefrom;

(b) a plurality of resonant tubes having upper and lower ends, the upper ends of said tubes being suspended from said frame and said tubes being arranged in a circular, symmetrically spaced vertical array;

(c) a circular disc like clapper positioned horizontally within the inner boundary of said tubes and having a central opening;

(d) a clapper support comprising a hollow tube having upper and lower ends and formed with a selected number of circular turns between said tube ends, said tube upper end being mounted in said opening with the remainder of said tube residing below said clapper;

(e) a vertical strand having an upper end supported by said hanger means, a central portion passed through said opening and through said tube including the turns thereof and a lower end terminating below said tube lower ends, said clapper support tube being adapted to grasp said strand with sufficient frictional force to permit said clapper to be manually adjusted to any selected position on said strand in which position said clapper support is normally retained until manually positioned to another position thereby enabling the tonality of said tubes to be adjusted by adjusting the position of said clapper on said strand; and (f) a wind baffle secured to said strand lower end.

2. A wind chime assembly as claimed in claim 1 wherein said selected number of turns in said tube comprise two turns in a substantially common plane and located side by side.

3. A wind chime assembly as claimed in claim 1 wherein said selected number of turns in said tube comprise two turns in a substantially common plane one above the other.

* * * * *